United States Patent [19]

Shibata

[11] 4,348,161

[45] Sep. 7, 1982

[54] PRESSURE CONVERTING APPARATUS

[76] Inventor: Tsugio Shibata, 21-4, Yusentei, Nishi-ku, Fukuoka-shi, Fukuoka, Japan

[21] Appl. No.: 149,054

[22] Filed: May 12, 1980

[30] Foreign Application Priority Data

Mar. 15, 1980 [JP] Japan ..... 55-32845

[51] Int. Cl.[3] ..... F04B 17/00; F15B 7/02

[52] U.S. Cl. ..... 417/403; 60/537; 60/547 R; 60/591; 91/313; 91/342

[58] Field of Search ..... 91/304, 313, 342; 417/403, 391; 60/537, 547 R, 591

[56] References Cited

U.S. PATENT DOCUMENTS

| | | | |
|---|---|---|---|
| 2,420,896 | 5/1947 | Meyers | 91/313 |
| 3,093,122 | 6/1963 | Sachnik | 91/342 |
| 3,949,644 | 4/1976 | Suechting | 91/304 |
| 4,062,639 | 12/1977 | Conlee | 91/313 |
| 4,096,059 | 6/1978 | Pinkerton | 417/391 |

*Primary Examiner*—Abraham Hershkovitz
*Attorney, Agent, or Firm*—Jordan and Hamburg

[57] ABSTRACT

Pressure converting apparatus which automatically and continuously converts low pressure fluid into high pressure fluid comprises low pressure and high pressure cylinders which are coaxially connected, but have different effective bore areas, a co-working piston rod which reciprocates in the chambers of the coaxial cylinders, an automatic pilot valve operating mechanism disposed at the rear end of the low pressure cylinder, and a fluid supply mechanism for supply a bypassed fluid into the high pressure cylinder. Due to the difference in effective bore areas of the low pressure and high pressure cylinders and the automatic reciprocation of the coaxial piston rod in the chambers effected by the automatic pilot valve operating mechanism, high pressure fluid is constantly produced at the high pressure cylinder as the low pressure fluid is continuously supplied into the low pressure cylinder.

3 Claims, 4 Drawing Figures

PRESSURE CONVERTING APPARATUS

BACKGROUND OF INVENTION

This invention relates to an apparatus for producing operating fluid of high pressure from operating fluid of low pressure.

Conventionally, hydraulically-operated devices or apparatus used in the various fields of industry (e.g. construction, transportation, agriculture) are mainly operated with an operating fluid of low pressure (70~210 kg/cm$^2$). However, among such hydraulically-operated devices, there exist several devices which requires a fluid circuit of high pressure (700~1000 kg/cm$^2$) such as hydraulic jacks, shearing machines, or press means and also devices which show better operating performance with high pressure fluid than low pressure fluid.

Conventionally, for operating such devices which necessitate or prefer fluid at high pressure, a hydraulic motor is primarily driven by a fluid of either intermediate or low pressure and subsequently the output of the motor is imparted to a plunger pump for producing the high pressure fluid. In another conventional method or device, two pressure increase mechanisms which have different pressure areas are alternately driven by the actuation of valve means such as solenoid valves, wherein two pressure increase mechanisms are alternately reciprocated so as to produce a high pressure fluid on the high pressure side of the device. However, since the above-mentioned conventional methods or devices require additional or separate devices besides the pressure increase mechanisms, the entire construction of the devices become complicated and cumbersome resulting in high production cost.

It is an object of the present invention to provide a pressure converting apparatus which can automatically and accurately convert fluid of low pressure to fluid of high pressure.

It is another object of the present invention to provide a pressure converting apparatus which can be produced at a considerably low cost.

The pressure converting apparatus of this invention, in summary, comprises:

(a) low pressure and high pressure cylinders connected coaxially, such respective cylinders having low pressure and high pressure cylinder chambers of different effective bore areas, (b) a coaxial piston rod slidably disposed in the coaxial low pressure and high pressure cylinder chambers, the coaxial piston rod being provided with low pressure and high pressure pistons at opposed longitudinal ends thereof, the low pressure and high pressure pistons dividing the respective cylinder chambers into a front piston chamber and a rear piston chamber, (c) a rear cover block attached to the rear of the low pressure cylinder, the rear cover block incorporating a low pressure liquid inlet and directional control and pilot valves, the directional control valve and pilot valve cooperating so as to alternately supply low pressure fluid into the front and rear piston chambers of the low pressure cylinder, (d) an automatic pilot valve operating mechanism incorporated in the rear cover block, said mechanism being operably interconnected with the movement of said piston rod so as to operate said pilot valve, corresponding to the movement of said piston rod, (e) a secondary fluid supply line bypassing a portion of low pressure fluid discharged from the pilot valve to the chambers of high pressure cylinder, and (f) a suction valve and an exhaust valve disposed in the secondary fluid supply line, such suction and exhaust valves being operably interconnected with the movement of the high pressure piston in the high pressure cylinder chambers enabling the high pressure cylinder to pump out high pressure fluid through a high pressure fluid outlet formed in the high pressure cylinder twice per one reciprocation of the coaxial piston rod.

DETAILED DESCRIPTION OF THE DISCLOSURE

Figure 1:
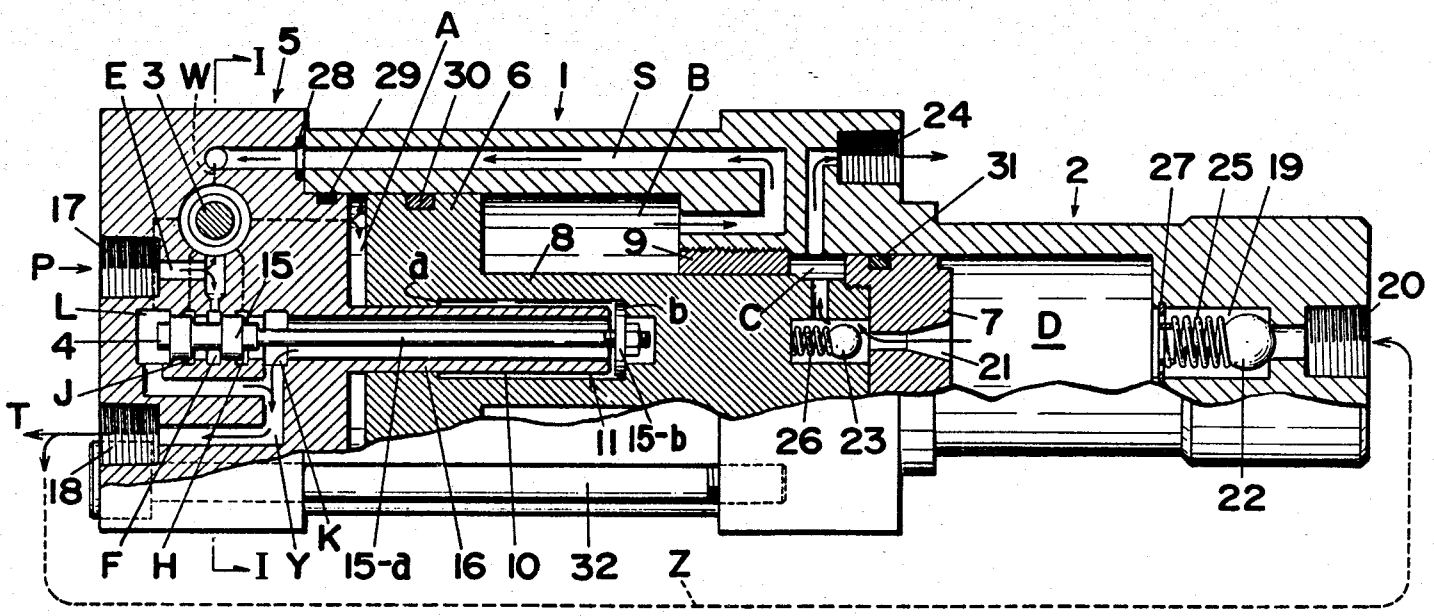
FIG. 1 is a front view partially broken away and in section of the pressure converting apparatus of this invention.

The apparatus of this invention is hereinafter disclosed in conjunction with attached drawings FIG. 1 to FIG. 4.

The pressure converting device, as shown in the drawings, substantially comprises a low pressure cylinder 1, a high pressure cylinder 2 and a rear cover block 5 which includes a directional control valve 3 and a pilot valve 4.

In the above construction, the low pressure cylinder 1 and the high pressure cylinder 2 are integrally and coaxially connected and have low pressure and high pressure cylinder chambers therein respectively. A coworking piston rod 8 which has a low pressure piston 6 and a high pressure piston 7 formed at respective longitudinal ends thereof is slidably disposed in the coaxial cylinder chambers. It is needless to say that the low pressure and high pressure cylinder chambers are tightly and completely partitioned by a metal bushing 9. Furthermore, the low pressure cylinder chamber is divided into a front piston chamber A and a rear piston chamber B by the low pressure piston 6, while the high pressure cylinder chamber is also divided into a front piston chamber C and a rear piston chamber D by the high pressure piston 7.

The rear cover block 5 which, as described above, is mounted at the rear end of the low pressure cylinder 1 and incorporates the directional control valve 3 and the pilot valve 4 therein also includes an automatic pilot valve operating mechanism 11 which extends into a longitudinal cavity 10 formed in the rear end of the piston rod 8.

Figure 2:
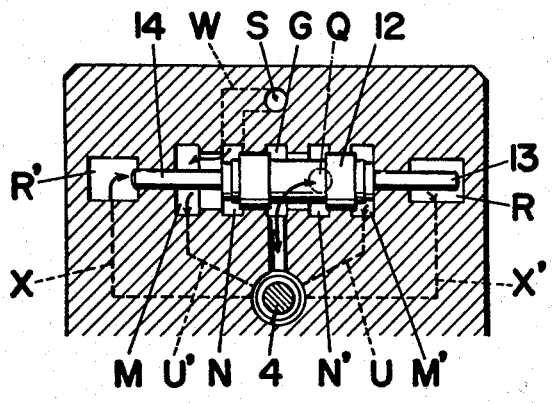
FIG. 2 is a cross sectional view taken along the line I—I of FIG. 1.
Figure 4:
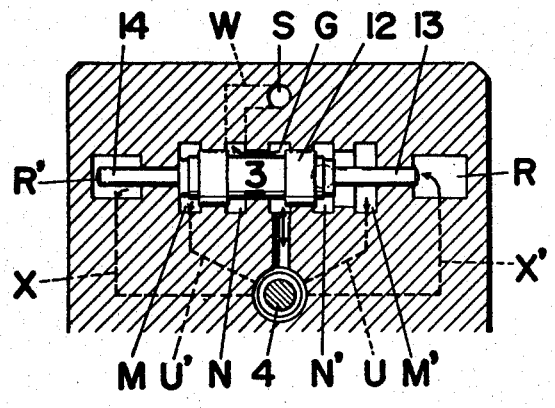
FIG. 4 is a cross sectional view taken along the line II—II of FIG. 3.

The construction of the directional control valve 3 is shown in details in FIG. 2 and FIG. 4, wherein numeral 12 indicates a valve shaft, numerals 13 and 14 indicate plungers form on the both ends of the valve shaft 12, R, R′ indicate plunger chambers which encase plungers 13 and 14 respectively, and letters G, M, M′, N, N′ are port chambers.

Figure 3:
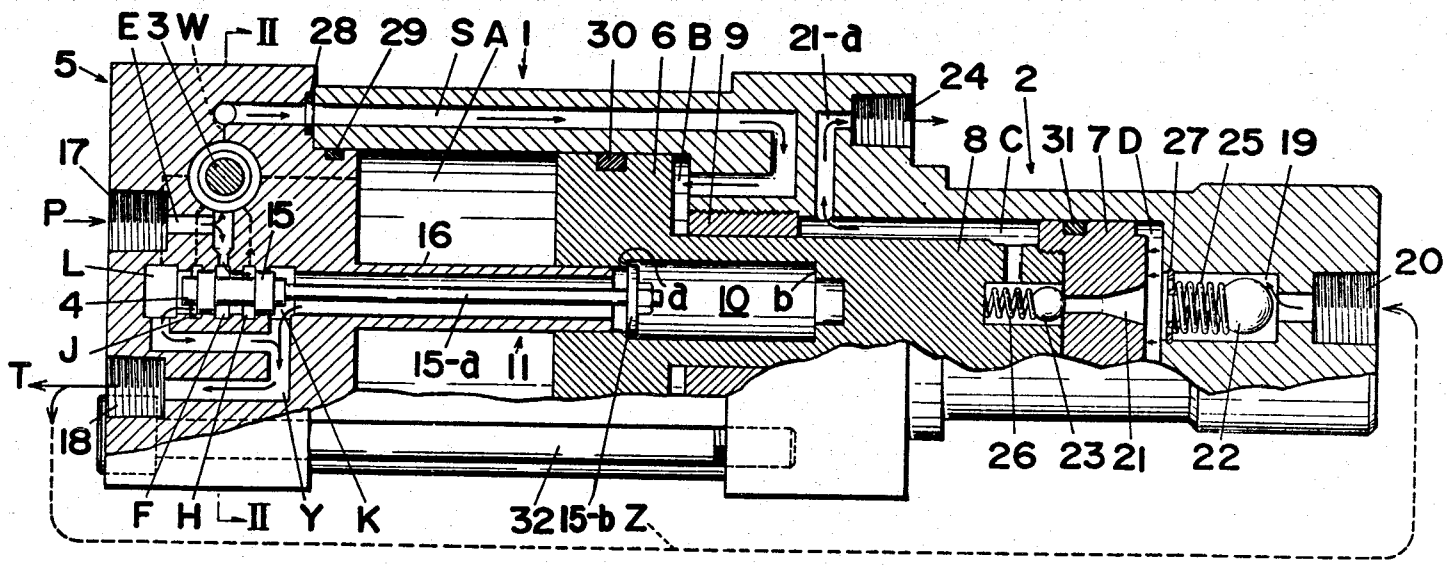
FIG. 3 is another front view partially broken away and in section of the pressure converting apparatus of this invention in a different operating position.

The construction of the pilot valve 4 is shown in detail in FIG. 1 and FIG. 3, wherein numeral 15 indicates a valve shaft, and letters F, H, J, K, L are port chambers.

The automatic pilot valve operating mechanism 11 is constructed such that a plunger sleeve 16 which has the proximal end thereof fixed to the front surface of the rear cover block 5 extends into the rear cavity 10 formed in the piston rod 8. An extension 15-*a* of the valve shaft 15 of the pilot valve 4 passes through the plunger sleeve 16 and extends into the above cavity 10, and a limit plate 15-*b* is mounted on the extremity of the extension 15-*a*.

The rear cover block 5 is also provided with a low pressure fluid supply inlet 17 which supplies the low pressure fluid from a low pressure fluid supply circuit P to the directional control valve 3 and the pilot valve 4 and a low pressure fluid discharge outlet 18 through which the low pressure fluid from the pilot valve 4 returns to a fluid storage tank (not shown in the drawing) by way of a low pressure fluid return circuit (T).

Furthermore, as shown in FIG. 1 and FIG. 3, a secondary low pressure fluid supply mechanism is incorporated in the front portion of the high pressure cylinder 2, wherein the mechanism works so as to supply the low pressure fluid bypassed from the fluid return circuit T into the cylinder chambers C and D of the high pressure cylinder 2.

The secondary low pressure supply mechanism is substantially constructed such that a secondary fluid supply inlet 20 is communicated with the front piston chamber D by way of a fluid suction passage 19, the front piston chamber D is then communicated with the rear piston chamber C by way of a fluid exhaust passage 21, and a suction valve 22 and an exhaust valve 23 are disposed in the fluid suction passage 19 and the fluid exhaust passage 21 respectively.

Referring to the other components of the apparatus of this invention, numeral 24 indicates a high pressure fluid pumping outlet which pumps out the high pressure fluid from the rear piston chamber C into a high pressure fluid circuit through the high pressure fluid exhaust passage 21-*a*, numerals 25, 26 indicate spring means which biasingly urge the suction valve 22 and the exhaust valve 23 onto the respective valve seats, numeral 27 indicates a spring mounting attachment, numerals 28, 29, 30 and 31 indicate seal elements, and numeral 32 indicates tie bolts.

As for the lines or circuits for carrying pressurized fluid, letter E indicates a line which supplies the low pressure fluid from the low pressure supply inlet 17 into the directional control valve 3 and the pilot valves 4, letter Q indicates a line which communicates the port chamber N′ of the directional control valve 3 with the rear piston chamber A, letters S and W indicate lines which communicate the port chamber N of the directional control valve 3 with the front piston chamber B, letters U, U′ indicate lines which communicate the port chambers M, M′ to the pilot valve 4, letters X, X′ indicate lines which communicate the plunger chambers R, R′ of the directional control valve with the port chambers J, H of the pilot valve 4, letter Y indicates a line which returns the low pressure fluid discharged from the pilot valve 4 into the low pressure fluid return circuit T by way of the fluid discharge outlet 18, and letter Z indicates a low pressure fluid bypass line which supplied a portion of the discharged low pressure fluid from the discharge outlet 18 into the high pressure cylinder 2.

The manner in which the pressure converting apparatus of this invention is operated is hereinafter disclosed in conjunction with the attached drawings.

Primarily when the low pressure fluid is supplied into the rear cover block 5 by way of the low pressure fluid inlet 17, the fluid passes through the line E and flows in the port chamber G of the directional control valve 3 as well as the port chamber F of the pilot valve 4. (In FIG. 1, the limit plate 15-*b* is shown at the utmost withdrawn position as being urged leftward by a front shoulder portion b of the cavity 10 formed in the piston rod 8, wherein the port chambers F and J are communicated with each other and the port chamber H of the pilot valve 4 is communicated with the port chamber L of the pilot valve 4 by way of the line Y and eventually with the fluid discharge outlet 18). The low pressure fluid which enters the port chamber J of the pilot valve 4 passes through the line X and flows into the plunger chamber R′ so as to push the plunger 14 forward in an axial direction.

Corresponding to the axial movement of the plunger 14, the plunger 13 also moves in the same axial direction so that the fluid in the plunger chamber R passes through the line X′ and is discharged to the low pressure fluid return circuit T by way of the port chamber H of the pilot valve 4 and the line Y. Due to the above flow of the fluid, the directional control valve 3 is shifted by the plunger 14 so that the port chambers G and N′ of the directional control valve 3 are communicated with each other and simultaneously the port chambers N and M of the directional control valve 3 are also communicated with each other. Accordingly, the low pressure fluid flows from the port chamber G of the directional control valve 3 into the rear piston chamber A of the low pressure cylinder 1 by way of the line G and moves the piston rod 8 in an axial direction. Simultaneously, the low pressure fluid in the front piston chamber B of the low pressure cylinder 1 is discharged through the fluid discharge outlet T by way of the line S, the line W, the port chambers N and M of the directional control valve 3 and the line U′. Due to the above flow of the fluid, the piston rod 8 moves forward. Along with the movement of the piston rod 8, the fluid pressure within the front piston chamber D of the high pressure cylinder 2 is increased so as to close the suction valve 22, and simultaneously the pressure-increased fluid forcibly opens the exhaust valve 23 against the resilient force of the spring 26 and flows into the rear piston chamber C of the high pressure cylinder 2. A portion of the fluid which enters the rear piston chamber C in the above manner is pumped out as a high pressure fluid from the high pressure fluid pumping outlet 24.

When the piston rod 8 which is actuated in the above manner reaches a terminal or dead end position as shown in FIG. 3, the limit plate 15-*b* comes into contact with a rear shoulder portion a of the cavity 10 of the piston rod 8 and moves the valve shaft 15 of the pilot valve 4. Due to such shifting of the pilot valve 4, the direction of the flow in the apparatus also changes in the following manner. Namely, the low pressure fluid in the pilot valve 4 flows into the plunger chamber R by way of the port chambers F and H of the pilot valve 4 and the line X′ and moves the plunger 13 of directional control valve 3 in an axial direction. Corresponding to the shifting of the plunger 13, the plunger 14 in the plunger chamber R′ also shifts and as a result, the fluid in the plunger chamber R′ is discharged toward the fluid discharge outlet 18 by way of the line X, the port chambers J and L of the pilot valve 4 and the line Y. In this manner, the directional control valve 3 is shifted. Accordingly, the low pressure fluid in the directional control valve 3 flows into the front piston chamber B of the low pressure side cylinder 1 by way of the port chambers G and H of the directional control valve 3, the line W, the line S, while the low pressure fluid in the rear piston chamber A of the low pressure cylinder A is discharged toward the fluid discharge outlet 18 by way of the line Q, the port chambers N′, M′ of the directional control valve 3, the line U, the port chamber K of the pilot valve 4 and the line Y. Due to the above flow of the fluid, the piston rod 8 moves backward. Along with the backward movement of the piston rod 8, the high pressure side piston 7 also moves backward. As the piston 7 moves backward, the suction valve 22 opens and supplies a portion of the discharged low fluid into the front piston chamber D of the high pressure cylinder 2 from the low pressure fluid bypass line Z, while the exhaust valve 23 closes so as to provide the pumping of the high pressure fluid from the rear piston chamber C of the high pressure cylinder 2 through the high pressure fluid pumping outlet 24.

As long as low pressure fluid is constantly supplied into the pressure converting apparatus of this invention through the low pressure fluid supply inlet 17, the apparatus conducts the automatic reciprocation of the piston rod 8 within the low pressure cylinder 1 and the high pressure cylinder 2 in the manner described above.

In the above pressure converting operation, the ratio of the pressure between the low pressure fluid and the high pressure fluid is determined at will by preferably selecting the effective areas of the front and rear piston chambers A, B, C, D of the respective cylinders 1 and 2. To be more specific, the pressure ratio can be readily determined by the following formula, A: (D−C)=B:C.

As has been described above, the apparatus of this invention has the following advantages:

(1) The apparatus of this invention can automatically convert low pressure fluid into high pressure fluid without necessitating a separate power generating mechanism or device. Accordingly, the apparatus can be produced at a considerably low cost while maintenance of the apparatus is also simplified.

(2) Compared to the single-action type plunger pump, the apparatus of this invention can produce high pressure liquid of a lesser pulsation amplitude.

(3) Since complicate mechanisms such as electric control devices or rotary mechanisms can be obviated, the apparatus of this invention is almost totally free from the troubles or malfunctions.

What we claim is:

1. Pressure converting apparatus comprising:

(a) low-pressure and high-pressure-producing cylinders connected coaxially, said respective cylinders having low-pressure and high-pressure-producing cylinder chambers of different effective bore areas, said bore area of said high-pressure-producing cylinder chamber being smaller than said bore area of said low-pressure-producing cylinder chamber;

(b) a coaxial piston rod slidably disposed in said coaxial low-pressure and high-pressure-producing cylinder chambers, said coaxial piston rod being provided with low-pressure and high-pressure-producing pistons at opposed longitudinal ends thereof, said low-pressure and high-pressure-producing pistons each dividing said respective cylinder chambers into a front piston chamber and a rear piston chamber;

(c) a rear cover block attached to the rear of said low-pressure cylinder, said rear cover block incorporating a low-pressure liquid inlet, a low-pressure liquid outlet, a directional control valve, and a pilot valve, said directional control valve and said pilot valve cooperating so as to alternatively supply low-pressure fluid into said front and rear piston chambers of said low-pressure-producing cylinder, thus enabling an automatic reciprocation of said piston rod;

(d) an automatic pilot valve operating mechanism incorporated in said rear cover block, said mechanism being operably interconnected with the movement of said piston rod so as to automatically operate said pilot valve corresponding to the reciprocal movement of said piston rod;

(e) a secondary fluid by-pass line directly supplying a portion of said low-pressure fluid discharged from said pilot valve to said high-pressure-producing cylinder;

(f) a front cover block attached to the front of said high-pressure-producing cylinder, a suction valve disposed in said front cover block and communicating said secondary fluid by-pass line with said front piston chamber of said high-pressure-producing cylinder allowing one-way supplying of said low-pressure fluid to said front piston chamber of said high-pressure-producing cylinder from said pilot valve;

(g) an exhaust valve disposed in a front portion of said coaxial piston rod, said exhaust valve communicating said front piston chamber of said high-pressure-producing cylinder with said rear piston chamber of said high-pressure-producing cylinder through a passage formed in said high-pressure-producing piston allowing one-way supplying of said low-pressure fluid into said rear piston chamber of said high-pressure-producing cylinder from said front piston chamber of said high-pressure-producing cylinder; and (h) a high-pressure-fluid outlet formed in said high-pressure-producing cylinder, said high-pressure-fluid outlet communicating with said rear piston chamber of said high-pressure-producing cylinder;

whereby, upon said automatic reciprocation of said coaxial piston, said low-pressure fluid is pressurized in said front piston chamber of said high-pressure-producing cylinder twice per one reciprocation of said coaxial piston rod thus converting said low-pressure liquid to a high pressure liquid and said high-pressure liquid is pumped out through said high-pressure-fluid outlet.

2. Pressure converting apparatus according to claim 1, wherein said automatic pilot valve operating mechanism comprises a plunger sleeve which has the proximal end thereof fixed to said rear cover block, said piston rod having a rear cavity, said plunger sleeve extending into said rear cavity, said pilot valve having a valve shaft with an extension which passes through said plunger sleeve and extends into said rear cavity, and a limit plate mounted on the front extremity of said pilot valve shaft extension, said limit plate alternately coming into contact with shoulder portions formed on the opposed longitudinal ends of said rear cavity corresponding to the movement of said piston rod such that said pilot valve operating mechanism axially shifts said pilot valve shaft for each reciprocable movement of said coaxial piston.

3. Pressure converting apparatus according to claim 1, wherein the ratio between the low pressure fluid at said low pressure liquid inlet and the high pressure at said high pressure fluid outlet is predetermined by selecting the effective areas of the respective front and rear piston chambers according to the following:

$$A/(D-C)=B/C$$

where:

A = the effective area of said rear piston chamber of said low-pressure-producing chamber, B = the effective area of said front piston chamber of said low-pressure-producing chamber, C = the effective area of said front piston chamber of said high-pressure-producing chamber, and D = the effective area of said rear piston chamber of said high-pressure-producing chamber.

* * * * *